US005201113A

United States Patent [19]

Honma et al.

[11] Patent Number: 5,201,113

[45] Date of Patent: Apr. 13, 1993

[54] AUXILIARY EQUIPMENT FOR REMOVING PARTS INSTALLED ON CAN END DOUBLE-SEAMING MACHINE OR INSTALLING SUCH PARTS THEREON

[75] Inventors: Toru Honma, Ohmiya; Izumi Matsushita, Koshigaya; Yoshiteru Kojika, Saitama; Noboru Sasaki, Kitamoto, all of Japan

[73] Assignee: Hokkai Can Co., Ltd., Tokyo, Japan

[21] Appl. No.: 748,781

[22] Filed: Aug. 22, 1991

[30] Foreign Application Priority Data

Aug. 27, 1990 [JP] Japan ..... 2-222512

[51] Int. Cl.[5] ..... B23P 19/04

[52] U.S. Cl. ..... 29/822; 29/240; 29/281.4

[58] Field of Search ..... 29/426.1, 426.3, 426.5, 29/822, 240, 240.5, 281.1, 281.4

[56] References Cited

U.S. PATENT DOCUMENTS

| | | | |
|---|---|---|---|
| 2,166,382 | 7/1939 | Temple | 29/240 X |
| 2,374,871 | 5/1945 | Loveman | 29/240 |
| 2,542,053 | 2/1951 | Pechy . | |
| 3,245,372 | 4/1966 | Bofinger et al. . | |
| 4,843,702 | 7/1989 | Charest | 29/240 |
| 4,879,797 | 11/1989 | Yoshioka et al. | 29/240 |

*Primary Examiner*—Joseph M. Gorski

[57] ABSTRACT

Disclosed herein is an auxiliary equipment for removing parts including a cover feed turret, which has been vertically detachably installed by a screw member on a can end double-seaming machine for seaming a can end on a can body, from the double-seaming machine, or installing such parts on the double-seaming machine. The auxiliary equipment comprises a swinging member supported below the cover feed turret and horizontally swingable to under a screwing position of the screw member; the first pedestal replaceably positioned on the swinging member, on which the cover feed turret can be placed when the swinging member is swung to the screwing position of the screw member; and the second pedestal replaceably positioned on the connecting member, on which a cover guide can be placed. The swinging member and first pedestal are each provided with an operation hole through which the screw member can be operated by an operating tool through the swinging member and first pedestal from below the swinging member and first pedestal when the swinging member and first pedestal are swung to a position under the screw member.

11 Claims, 6 Drawing Sheets

AUXILIARY EQUIPMENT FOR REMOVING PARTS INSTALLED ON CAN END DOUBLE-SEAMING MACHINE OR INSTALLING SUCH PARTS THEREON

BACKGROUND OF THE INVENTION

1) Field of the Invention

The present invention relates to an auxiliary equipment suitable for use in removing parts such as a cover guide, a cover feed turret and a rotating drive shaft for the cover feed turret, which have been installed on a can end double-seaming machine for seaming a can end on a can body, from the seaming machine or installing such parts on the double-seaming machine.

2) Description of the Related Art

In production lines for cans, sealed cans and the like, there has heretofore been well known, a double end seaming machine for seaming a can end on a can body, such as a machine having the structure illustrated in FIGS. 6 and 7 by way of example.

This double end seaming machine comprises, as principal components, a base 50 and a frame 52 installed and supported on the upper parts of a plurality of stanchions 51 provided upright on the base 50. As illustrated in FIG. 6, a plurality of lifters 53 are provided rotatably about a main shaft 54 on the base 50. In the frame 52, a seaming head 57 equipped with a seaming chuck 55 and a seaming roll 56 above the lifter 53 is provided rotatably about the main shaft 54.

Upon seaming a can end on a can body (not illustrated), the can body is supported on each lifter 53, and the can end placed on the can body is held by the seaming chuck 55, thereby holding the can body and the can end between the lifter 53 and the seaming chuck 55. In this state, the can end is double-seamed on the can body by action of the seaming roll 56 and the seaming chuck 55.

This double end seaming machine is also equipped with a can end feeder 58 for feeding a can end to a can body supported on the lifter 53.

This can end feeder 58 comprises, as principal components, a cover guide 60 in a form of a plate, which has been horizontally provided in a fixed manner by a plurality of bolts 59 on the lower surface of the frame 52 at a position lateral to the seaming head 57, a horizontal cover feed turret 61 attached rotatably to the frame at a position contiguous to the cover guide 60 on the lower side thereof, and a rotating drive shaft 62 extending from the interior of the base 50 to the center of the cover feed turret 61.

The cover feed turret 61 is concentrically rotatably fitted over the body of a bolt 63, whose tip port has been inserted from the lower side of the cover guide 60 through it and screwed into the lower surface of the frame 52, through a bearing 64 and is detachably supported by the head 63*a* of the bolt 63, whereby it is attached to the frame 52.

In the cover guide 60, as illustrated in FIG. 6, a guide groove 66 for guiding a can end fed one by one from a cover magazine 65, which has been fitted to the cover guide 60, on a can body supported on the lifter 53 is defined in the form of a semiarc from a position, at which the cover magazine 65 has been fitted, to a position right above the lifter 53 along the outer periphery of the cover feed turret 61. In the guide groove 66, a plurality of pushing parts 67 which have been fixed at regular intervals on the peripheral part of the cover feed turret 61 project inwardly.

A connecting member 69 in the form of a cylinder is concentrically integrally fitted on the upper end of the rotating drive shaft 62, said connecting member 69 being concentrically fixed to the lower surface of the cover feed turret 61 by a plurality of bolts 68 at a position surrounding the head 63*a* of the bolt 63. Therefore, the rotating drive shaft 62 rotates together with the cover feed turret 61.

The lower portion of the rotating drive shaft 62 extends through a cylindrical body 70 provided in a fixed manner on the base 50 and extends into the base 50, and is fitted in a cylindrical body 72, said rotating drive shaft 62 and cylindrical body 72 being rotatable integrally with each other through a key 71. The cylindrical body 72 is rotatably detachably supported by the inner wall of the base 50 through a bearing 73. On the lower end of the cylindrical body 72, a driven gear 74 fitted concentrically on the lower end of the rotating drive shaft 62 is fixed in position by bolts 76. The driven gear 74 is meshed with a drive gear 75 fitted integrally rotatably on the main shaft 54 within the base 50.

In such a can end feeder 58, when the main shaft 54 is rotated by a driving means not illustrated, the cover feed turret 61 is rotated through the drive gear 75, the driven gear 74, rotating drive shaft 62 and the connecting member 69.

At this time, the can end fed from the cover magazine 65 to the guide groove 66 of the cover guide 60 is pushed by the pushing part 67 of the cover feed turret 61 toward the can body on the lifter 53 within the guide groove 66, and placed on the can body.

In such a double end seaming machine on the other hand, when the type of can body and can end to be seamed, particularly, their diameter is changed, the seaming chuck 55, the seaming roll 56, the cover guide 60 and the cover feed turret 61 are all changed according to the diameter of the can body and can end.

In this case, the cover feed turret 61 by way of example is manually changed in a manner described below.

Namely, upon changing the cover feed turret 61, the bolts 68 are first of all removed by an operator to separate the connecting member 69 and the rotating drive shaft 62 from the cover feed turret 61. At this time, the rotating drive shaft 62 and the connecting member 69 come down to a position where the rotating drive shaft 62 comes into contact with the bottom of the base 50 as indicated by imaginary lines in FIG. 7

The head 63*a* of the bolt 63 is then turned to take the bolt 63 out of the frame 52, thereby removing the cover feed turret 61 from the frame 52. At this time, since the cover feed turret 61 is a heavy part, another operator must hold the cover feed turret 61 with his hands in advance before the bolt 63 is taken off.

When the cover feed turret 61 is installed on the frame 52, the above-described operation is conducted in reverse.

In such an operation method, however, when the cover feed turret 61 is removed from or installed on the frame 52, the bolt 63 must be taken off or put on in a state that the cover feed turret 61 has been held with hands by another operator because it is heavy. Therefore, a plurality of operators are required. There is also a disadvantage that the operation requires much time and labor.

SUMMARY OF THE INVENTION

In order to solve such disadvantages, the present invention has as its object the provision of an auxiliary equipment for removing or installing parts, which permits the removal of parts installed on a can end double-seaming machine for seaming a can end on a can body or the installation of such parts with ease by one operator.

In order to achieve such an object, in an aspect of this invention, there is thus provided auxiliary equipment for removing a cover feed turret, which has been vertically detachably installed by a screw member on a can end double-seaming machine for seaming a can end on a can body, from the double-seaming machine, or installing such a cover feed turret on the double-seaming machine, which comprises a swinging member supported below the cover feed turret and horizontally swingable to under a screwing position of the screw member, and a pedestal replaceably placed on the swinging member, on which the cover feed turret can be placed when the swinging member is swung to the screwing position of the screw member, said swinging member and pedestal being each provided with an operation hole through which the screw member can be operated by an operating tool through the swinging member and pedestal from below the swinging member and pedestal when the swinging member and pedestal are swung to a position under the screw member.

According to such a means, upon the removal of the cover feed turret, the swinging member is swung together with the pedestal to right below the cover feed turret. When the screw member is operated in this state, the cover feed turret is detached downward and placed on the pedestal. Thereafter, the swinging member is swung to the original position, whereby the cover feed turret can be taken out of the double-seaming machine.

Incidentally, the installation of the cover feed turret may be done by conducting the above-described operation in reverse.

According to the present invention, it is therefore possible to perform the removal or installation of the cover feed turret with ease by one operator.

The auxiliary equipment according to the present invention further comprises an auxiliary means for removing or installing a rotating drive shaft driving the cover feed turret.

The auxiliary equipment according to the present invention further comprises an auxiliary means for removing or installing a cover guide together with the cover feed turret.

Other objects, advantages and applicable range of the present invention will be readily appreciated from the detailed description of this invention, which will be described subsequently with reference to the accompanying drawings. However, it should be borne in mind that this invention is not limited to the following preferred embodiments. Various changes and modifications will be apparent to those skilled in the art from the following description.

DETAILED DESCRIPTION OF THE INVENTION AND PREFERRED EMBODIMENTS

Figure 1:
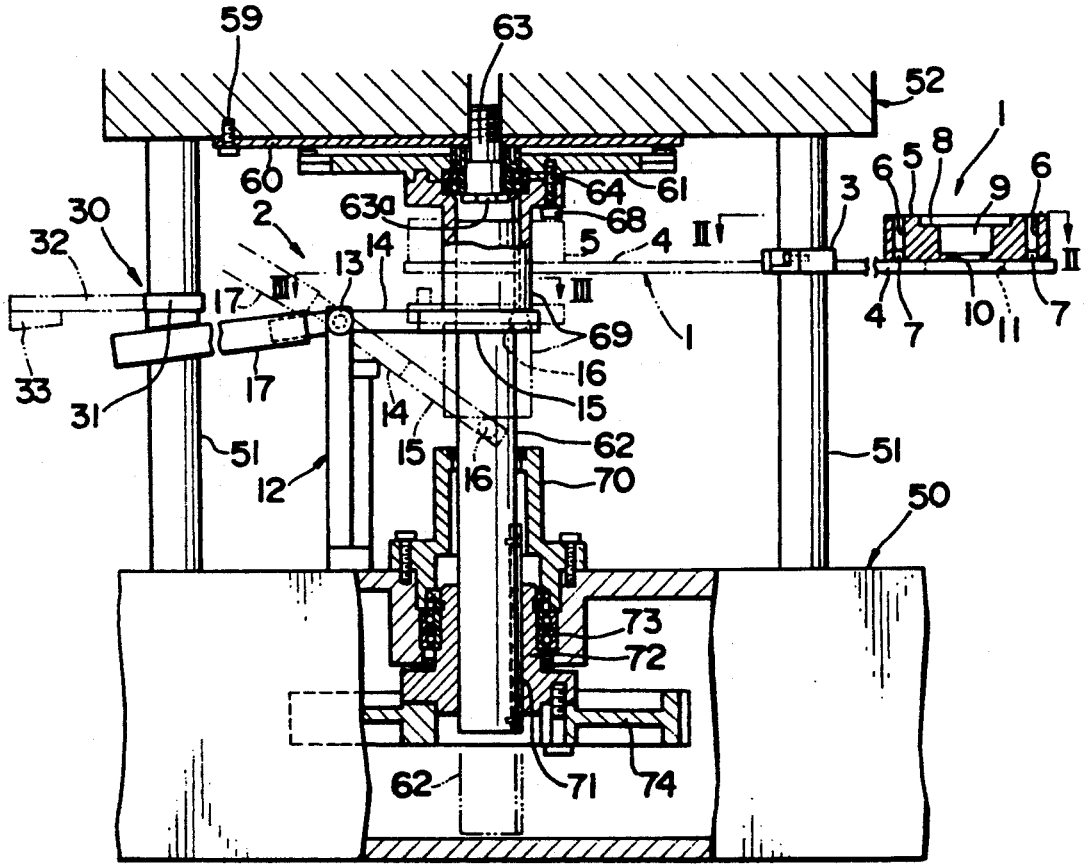
FIG. 1 is a side elevational view of a principal part of a can end double-seaming machine equipped with an auxiliary equipment for removing and installing a cover feed turret according to one embodiment of the present invention.
Figure 4:
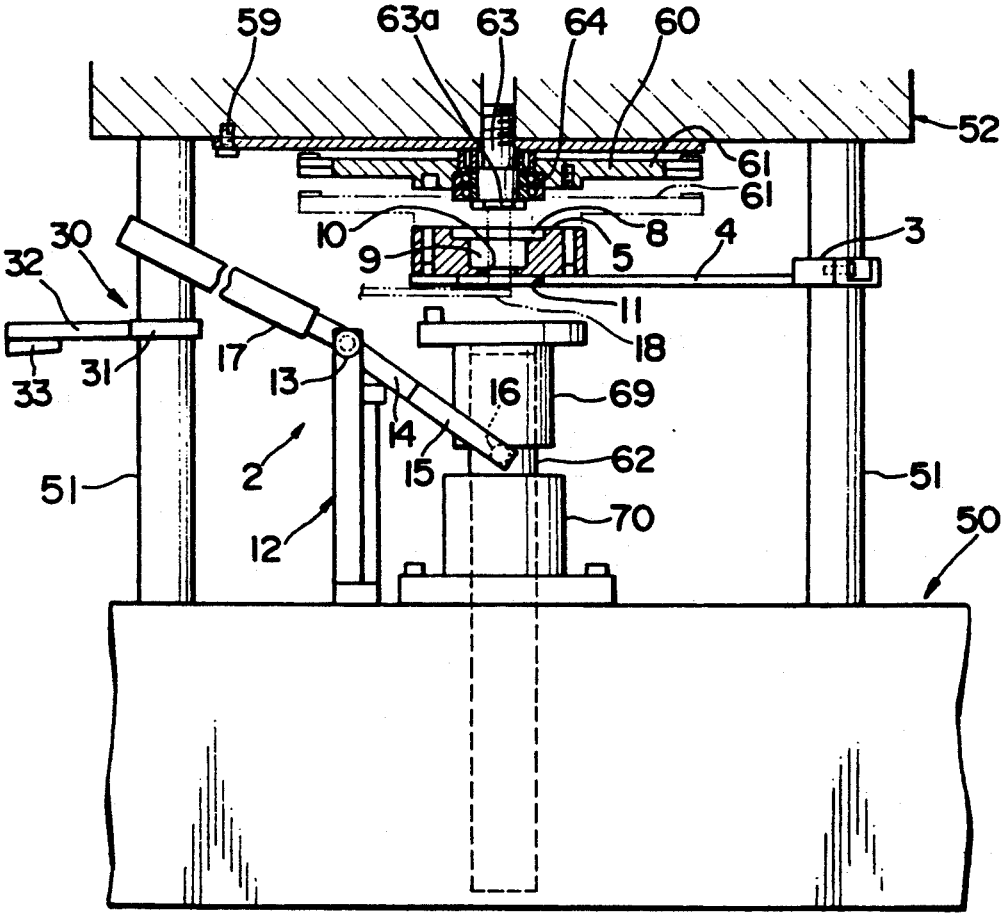
FIGS. 4 and 5 are explanatory illustrations to explain the operation of the auxiliary equipment.
Figure 5:
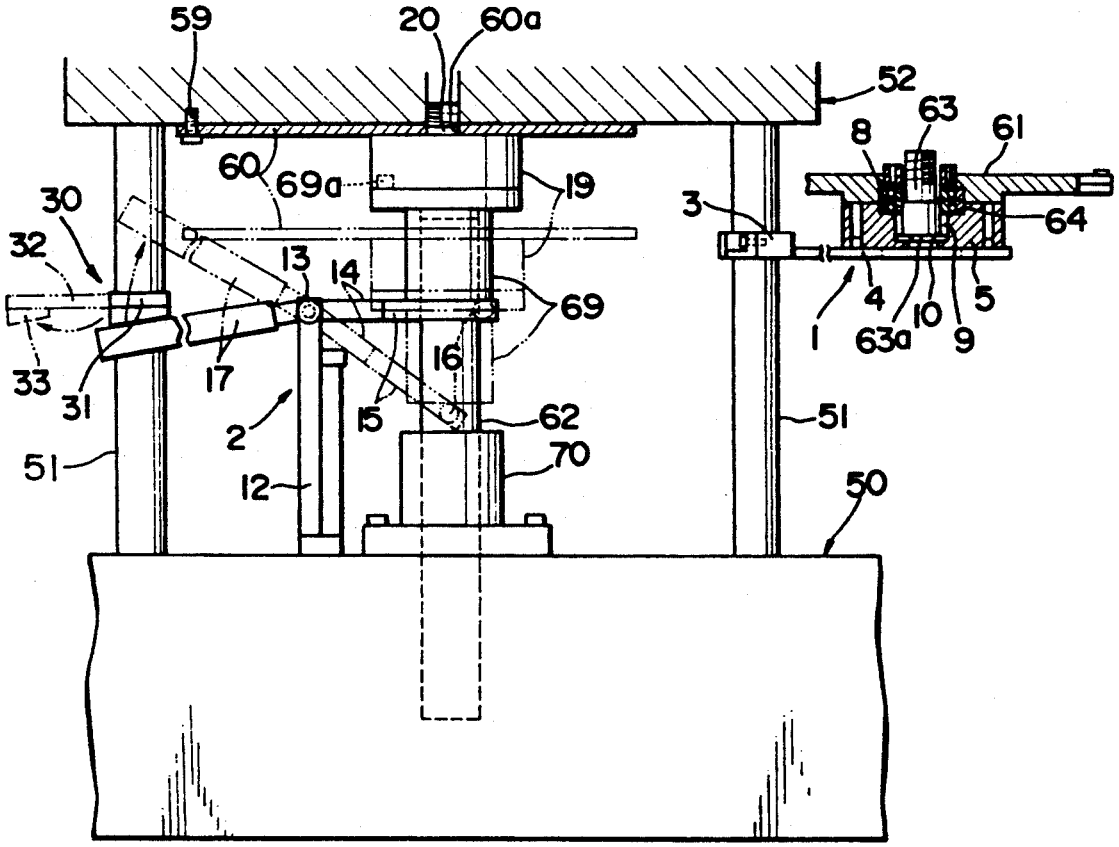

Auxiliary equipment for removing and installing parts according to one embodiment of this invention will hereinafter be described with reference to FIGS. 1 through 5. FIG. 1 is a side elevational view of a principal part of a can end double-seaming machine equipped with the auxiliary equipment, FIGS. 2 and 3 are cross-sectional views respectively taken along the lines II—II and III—III of FIG. 1, and FIGS. 4 and 5 are explanatory illustrations to explain the operation of the auxiliary equipment.

Figure 6:
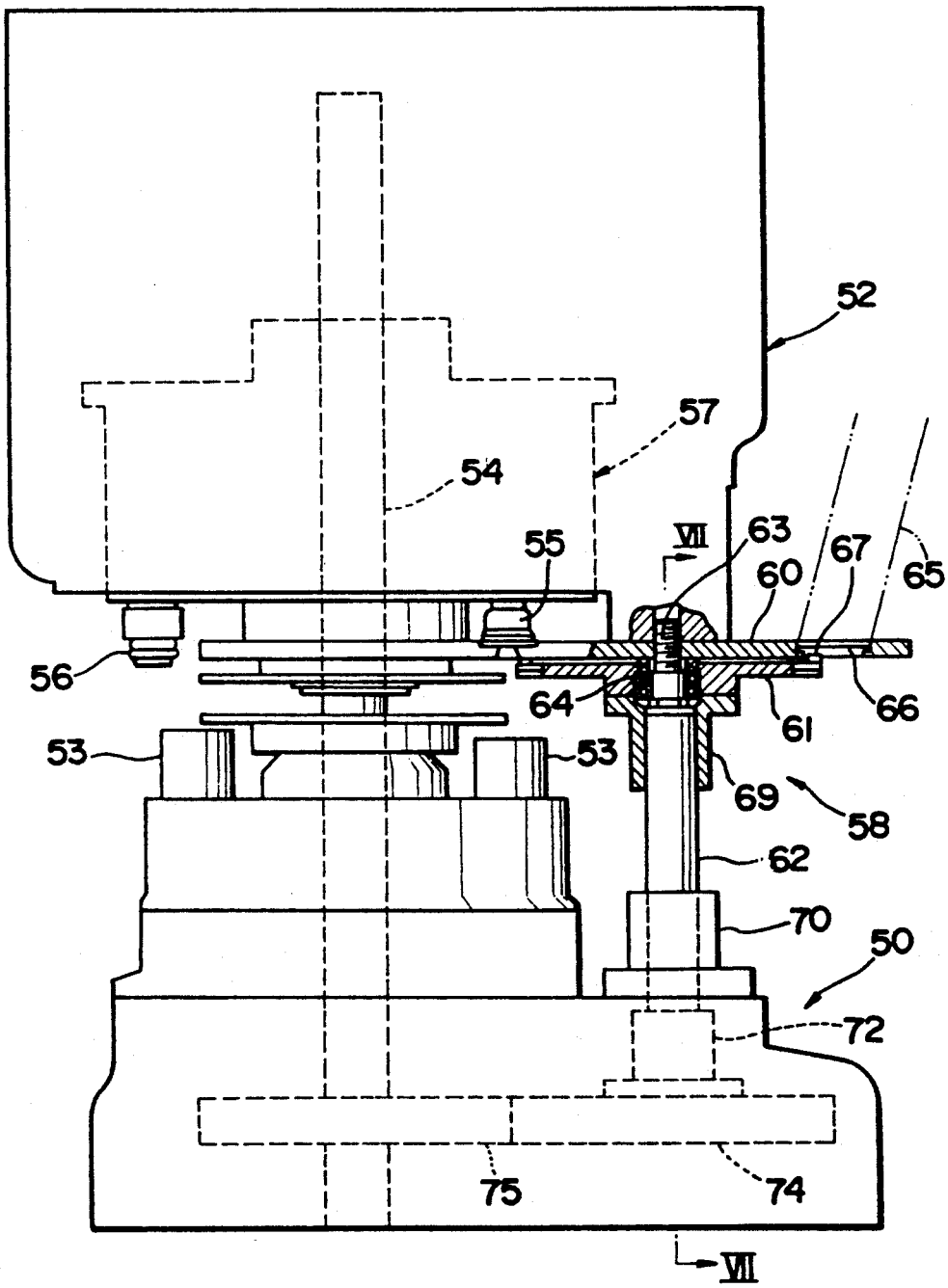
FIG. 6 is a front elevation illustrating a can end double-seaming machine.
Figure 7:
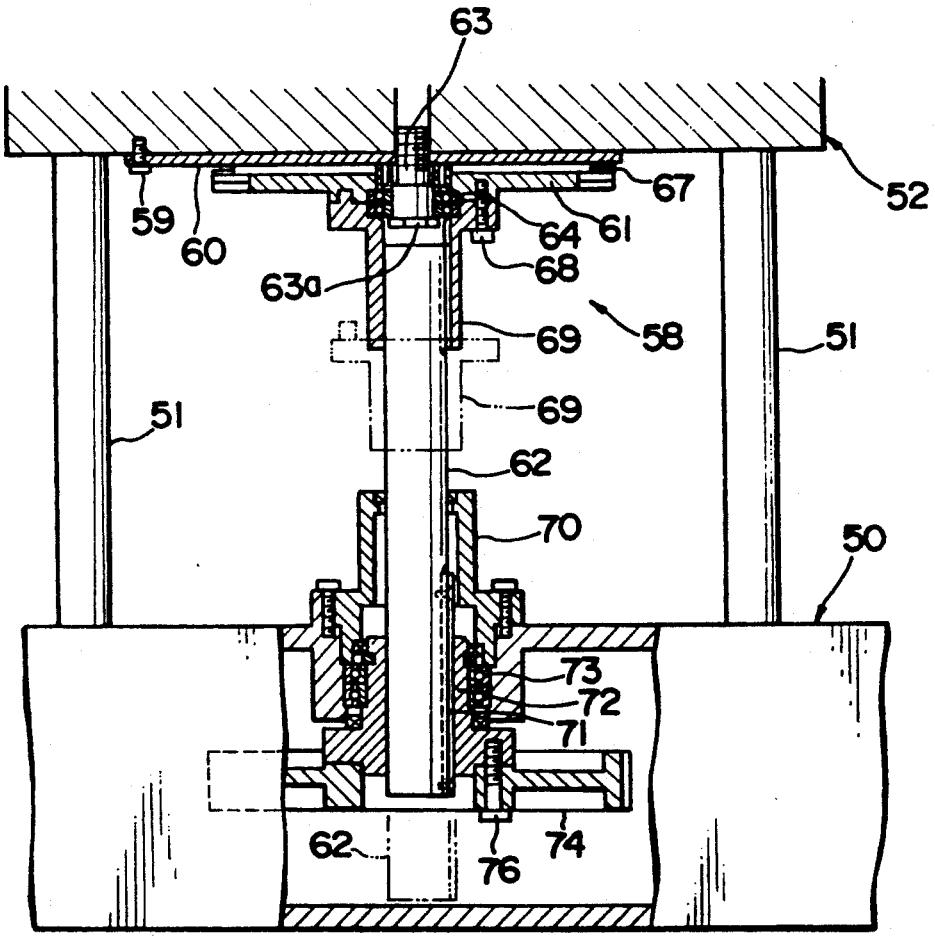
FIG. 7 is a cross-sectional view taken along the line VII—VII of FIG. 6

The structure of the double end seaming machine illustrated is not different from that of the conventional machine illustrated in FIGS. 6 and 7. Therefore, their corresponding parts are indicated by the same reference numerals as those in FIGS. 6 and 7 to describe the invention.

Figure 2:
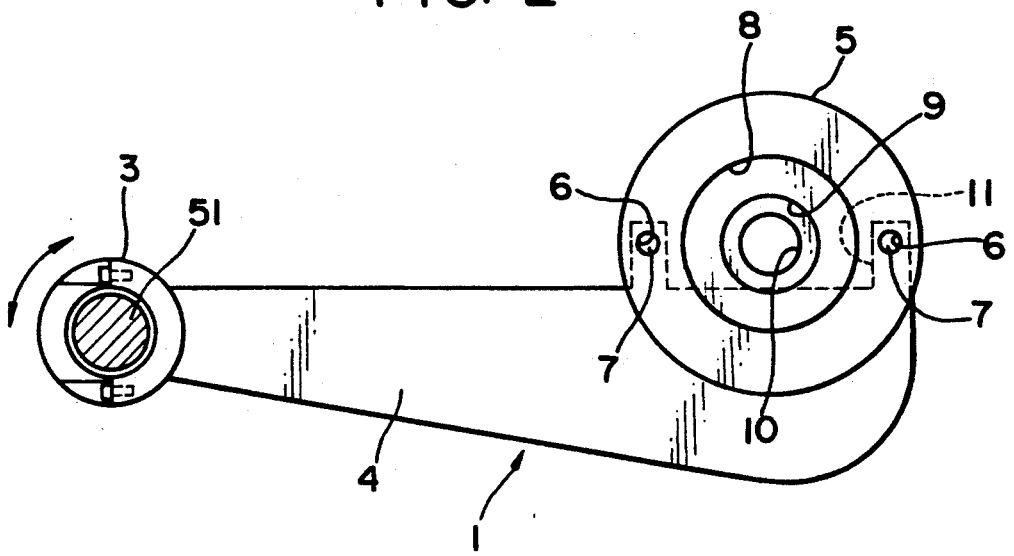
FIGS. 2 and 3 are cross-sectional views respectively taken along the lines II—II and III—III of FIG. 1.
Figure 3:
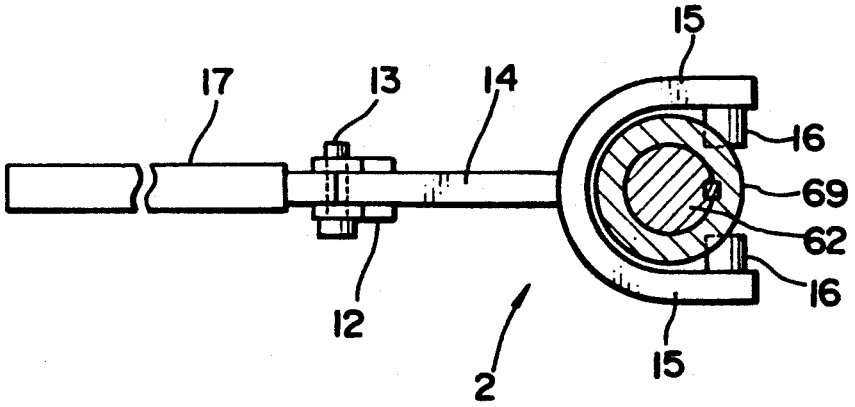

In FIGS. 1 through 3, an auxiliary equipment 1 is provided for removing and installing the cover feed turret 61, and an auxiliary equipment 2 is provided for removing and installing the rotating drive shaft 62 and the connecting member 69 upon the removal and installation of the cover feed turret 61 and the cover guide 60.

As illustrated in FIGS. 1 and 2, the auxiliary equipment 1 includes a swinging member 4 in the form of a plate, which extends integrally horizontally from a fitting part 3 swingably fitted on the upper portion of the stanchion 51, and the first pedestal 5 in the form of a disc, which has been provided so as to permit placing the cover feed turret 61 on the tip portion of the swinging member 4. The first pedestal 5 is replaceably positioned on the tip portion of the swinging member 4. A pair of positioning holes 6 are bored in the peripheral part of the first pedestal 5. In these holes 6, are fitted a pair of positioning pins 7, which have been provided on tip portions of the swinging member 4, whereby the first pedestal 5 can be replaceably attached to the swinging member 4 according to the type of the cover feed turret 61.

Therefore, plural types of pedestals according to the types of the cover feed turret 61 are provided as the first pedestal 5.

The swinging member 4 and the first pedestal 5 are horizontally swingable around the stanchion 51 through the fitting part 3. When the rotating drive shaft 62 and the connecting member 69 are lowered as indicated by imaginary lines in FIG. 1, the swinging member 4 and the first pedestal 5 can be swung to a position right under the cover feed turret 61.

In this case, as illustrated in FIGS. 1 and 2, there are defined in the upper central portion of the first pedestal 5 a concave part 8 capable of fitting the lower end of the bearing 64, which protrudes downward from the lower surface of the cover feed turret 61, therein, and another concave part 9 capable of fitting the head 63a of the bolt 63, which protrudes downward from the lower surface of the bearing 64, therein. As illustrated in FIG. 5, the concave part 9 has such a depth that when the cover feed turret 61 is placed on the first pedestal 5, the head 63a of the bolt 63 can be received to a position lower than its screwing position. The first pedestal 5 can carry the cover feed turret 61 concentrically about the bearing 64 in the state wherein the lower end of the bearing 64 and the head 63a of the bolt 63 are fitted into these concave parts 8 and 9, respectively.

In addition, an operation hole 10 through which the bolt 63 is operated, is bored in the central portion of the first pedestal 5 from its bottom to the lower surface of the concave part 9. The operation hole 10 opens downward through a kerf 11 defined in the side portion of the swinging member 4.

As illustrated in FIGS. 1 and 3, the auxiliary equipment 2 for removing or installing the rotating drive shaft 62 and the connecting member 69 includes a support 12, an arm 14, bifurcated part 15 and a grip 17. The support 12 is provided upright on the base 50 at a position lateral to the rotating drive shaft 62. The arm 14 is vertically swingably provided through a support shaft 13 so as to extend from the upper end of the support 12 toward the rotating drive shaft 62. The bifurcated part 15 is combined with the arm 14 and bifurcated at its distal end, and has the shape of the letter U. The grip 17 is connected to the proximal end of the arm 14 vertically swingably in unison with the arm 14, and is provided on the side opposite to the bifurcated part 15. The bifurcated part 15 is loosely fitted on the rotating drive shaft 62 at a position below the connecting member 69 so as to nip the rotating drive shaft 62. The arm 14 and the bifurcated part 15 are vertically swung on the support shaft 13 substantially along the rotating drive shaft 62 by holding the grip 17 and vertically moving it.

As illustrated in FIG. 3, a pair of projections 16 are provided on both tips of the bifurcated part 15 in such a manner that they are opposed to each other. These projections 16 are interlocked with the lower surface of the connecting member 69 when the bifurcated part 15 is swung toward the connecting member 69.

In such an auxiliary equipment 2, when the connecting member 69 is removed from the cover feed turret 61, as described above, in the state that the bifurcated part 15 is swung toward the connecting member 69 to interlock both projections 16 with the lower surface of the connecting member 69, the rotating drive shaft is detachably supported by the projections 16 through the connecting member 69.

In this state, the arm 14 and the bifurcated part 15 are swung by the grip 17, thereby vertically moving the rotating drive shaft 62 and the connecting member 69.

A locking mechanism 30 for making the swing of the arm 14 impossible is provided on a stanchion 51 near the support 12. With respect to the locking mechanism 30, its base 31 is swingably supported by the stanchion 51. An arm 32 extends integrally from the base 31, and a locking part 33 interlocking with the grip 17 from above at its lowered position is disposed at the distal portion of the arm 32. In such a locking mechanism, the arm 32 is swung to the lowered position of the grip 17 to interlock its locking part 33 with the grip 17 from above, thereby preventing the grip 17 from swinging upward. When the interlocking of the locking part 33 with the grip 17 is released, the upward swing of the grip 17 becomes possible.

When the arm 14 is locked so as to make its swing impossible in the state that both projections 16 have been engaged with the lower surface of the connecting member 69, the connecting member 69 and the rotating drive shaft 62 can be detachably support at a suitable position even if the operator does not hold the grip 17.

The operation of such auxiliary equipments 1 and 2 in the case of the removal or installation of the cover feed turret 61 will now be described with reference to FIGS. 1, 4 and 5.

For example, in the case where the cover feed turret 61 is removed, the arm 14 and the bifurcated part 15 are first of all swung toward the connecting member 69 by the grip 17, whereby the projections 16 are brought into contact with the lower surface of the connecting member 69 as indicated by the solid lines in FIG. 1. After the arm 14 is locked in this state, the bolts 68, by which the connecting member 69 has been attached to the cover feed turret 61 as described above, are removed to detachably support the connecting member 69 and hence the rotating drive shaft on the projections 16.

The arm 14 is then unlocked and at the same time, the grip 17 is held to swing the arm 14 and the bifurcated part 15 downward, thereby lowering the connecting member 69 and the rotating drive shaft 62 to separate them from the cover feed turret 61.

After they are lowered, as illustrated in FIG. 4, the swinging member 4 on which the first pedestal 5 of a type according to the type of the cover feed turret 61 has been placed is swung on the stanchion 51 to a position right under the cover feed turret 61 to position the first pedestal 5 concentrically with the cover feed turret 5.

As indicated by the imaginary lines in FIG. 4, a tool 18 such as a wrench for removing the bolt 63 by which the cover feed turret 61 has been attached to the frame 52 is then inserted into the operation hole 10 of the first pedestal 5 toward the bolt 63 through the kerf defined in the swinging member 4 to engage it with the head of the bolt 63. Thereafter, the bolt 63 is turned by the tool 18 to remove it from the frame 52.

At this time, the cover feed turret 61 gradually comes down toward the first pedestal 5 as the bolt 63 is turned, and at substantially the same time as the tip of the bolt 63 is taken out of the frame 52 and the cover guide 60, it is placed on the first pedestal 5 as indicated by the imaginary lines in FIG. 4. At this time, the head 63a of the bolt 63 and the lower end of the bearing 64 are fitted into the concave parts 9 and 8 of the first pedestal 5, respectively, whereby the cover feed turret 61 is removed together with the bolt 63 from the frame 52.

At this time, since the head 63a of the bolt 63 is received in the concave part 9 at a position lower than its screwing position, a vertical movement of the cover feed turret 61 upon its removal or installation can be made smaller.

Thereafter, the swinging member 4 is swung together with the first pedestal 5 and the cover feed turret 61 to a position outside the can end double-seaming machine, whereby the cover feed turret 61 can be taken out of the double-seaming machine.

Upon the removal of the cover feed turret 61, in addition, the cover guide 60 is also removed using the auxiliary equipment 2 as described below.

Namely, the removal of the cover guide 60 is conducted in the following manner. After removing the cover feed turret 61 as described above, the second pedestal 19 in the form of a thick disc, on which the cover guide 60 is placed, is placed on the connecting member 69 as illustrated in FIG. 5. The connecting member 69 and the rotating drive shaft 62 are lifted to their original positions by the auxiliary equipment 2.

At this time, the second pedestal 19 is placed concentrically with the connecting member 69 thereon by a positioning pin 69*a* provided on the upper periphery of the connecting member 69, and comes into contact with the lower surface of the cover guide 60 in a state that the connecting member 69 and the rotating drive shaft 62 have been lifted. A projection 20 is provided on the upper surface of the second pedestal 19, said projection 20 being fitted in a through-hole 60*a* of the cover guide 60, through which the bolt 63 taking part in the cover feed turret 61 is inserted, in the state wherein the connecting member 69 and the rotating drive shaft 62 have been lifted.

Thereafter, the bolts 59 by which the cover guide 60 has been attached to the frame 52 are removed, thereby permitting the placement of the cover guide 60 on the second pedestal 19, When the connecting member 69 and the rotating drive shaft 62 are lowered again by the auxiliary equipment 2 in this state, the cover guide 60 is removed as indicated by the imaginary lines in FIG. 5.

On the other hand, the installation of the cover feed turret 61 and the cover guide 60 can be conducted by using the first pedestal 5 and the second pedestal 19 according to the cover feed turret 61 and the cover guide 60, respectively, and operating the auxiliary equipment 1 and 2 in reverse order to that described above.

At this time, as illustrated in FIG. 5, the head 63*a* of the bolt 63 lowers to the concave part 9 of the first pedestal 5. Therefore, the bolt 63 is lifted toward a threaded hole of the frame 52 by the tool 18 such as a wrench for rotating the bolt 63 relative to the frame 52.

By the way, although the operation hole 10 and the kerf 11 have been provided in the first pedestal 5 and the swinging member 4, respectively, in the auxiliary equipment 1 according to this embodiment in order to operate the bolt 63, it is of course possible to provide a kerf in place of the operation hole 10 in the first pedestal 5 and also to provide an operation hole instead of the kerf 11 in the swinging member 4.

What is claimed is:

1. An auxiliary equipment for removing a cover feed turret from a can end double-seaming machine, and for installing the cover feed turret on the double-seaming machine, wherein the cover feed turret is vertically detachably installed by a screw member on said can end double-seaming machine for seaming a can end on a can body, said equipment comprising:

a swinging member supported proximate said double-seaming machine below the cover feed turret, said swinging member being horizontally swingable to a position underneath the screw member; and a pedestal replaceably positioned on the swinging member, on which the cover feed turret can be placed when the swinging member is swung to said position underneath the screw member, said swinging member and said pedestal being each provided with respective operation holes aligned with each other and through which the screw member can be operated by an operating tool passing through the swinging member and pedestal from below the swinging member and pedestal when the swinging member and pedestal are swung to said position underneath the screw member.

2. An auxiliary equipment as claimed in claim 1, wherein the pedestal has such a shape that the cover feed turret can be placed on the upper surface thereof, and the operation hole defined in the pedestal communicates with the operation hole provided in the swinging member.

3. An auxiliary equipment as claimed in claim 2, the upper surface of the pedestal is close to the lower surface of the cover feed turret when the pedestal is positioned together with the swinging member right under the screw member, and the operation hole defined in the pedestal as a concave part capable of receiving a head of the screw member at a position lowed from the cover feed turret when the screw member is unscrewed.

4. An auxiliary equipment for removing parts from a can end double-seaming machine, and for installing said parts on the double-seaming machine, said parts including a cover feed turret and a rotating drive shaft for driving the cover feed turret, wherein the cover feed turret is vertically detachably installed by a screw member on said can end double-seaming machine for seaming a can end on a can body, and the rotating drive shaft is vertically separably attached to the cover feed turret through a connecting member, said equipment comprising:

an auxiliary means for removing and installing the cover feed turret; and an auxiliary means for removing and installing the rotating drive shaft, which lifts and lowers the rotating drive shaft in conjunction with the connecting member when the connecting member is separated from the cover feed turret, said auxiliary means for removing and installing the cover feed turret comprising:

a swinging member supported proximate said double-seaming machine below the cover feed turret, said swinging member being horizontally swingable to a position underneath the screw member; and a pedestal replaceably positioned on the swinging member, on which the cover feed turret can be placed when the swinging member is swung to said position underneath the screw member, said swinging member and said pedestal being each provided with respective operation holes aligned with each other and through which the screw member can be operated by an operating tool passing through the swinging member and pedestal from below the swinging member and pedestal when the swinging member and pedestal are swung to said position underneath the screw member.

5. An auxiliary equipment as claimed in claim 4, wherein the pedestal has such a shape that the cover feed turret can be placed on the upper surface thereof, and the operation hole defined in the pedestal communicates with the operation hole provided in the swinging member.

6. An auxiliary equipment as claimed in claim 5, the upper surface of the pedestal is close to the lower surface of the cover feed turret when the pedestal is positioned together with the swinging member right under the screw member, and the operation hole defined in the pedestal has a concave part capable of receiving a head of the screw member at a position lowed from the cover feed turret when the screw member is unscrewed.

7. An auxiliary equipment as claimed in claim 4, wherein the auxiliary means for removing and installing the rotating drive shaft can hold the connecting member at a position connectable with the cover feed turret.

8. An auxiliary equipment for removing parts from a can end double-seaming machine, and for installing said parts on the double-seaming machine, said parts including a cover guide, a cover feed turret and a rotating drive shaft for driving the cover feed turret, wherein the cover feed turret is vertically detachably installed by screw members on said can end double-seaming machine for seaming a can end on a can body, and the rotating drive shaft is vertically separably attached to the cover feed turret through a connecting member, said equipment comprising:

an auxiliary means for removing and installing the cover guide and the cover feed turret; and an auxiliary means for removing and installing the rotating drive shaft, which lifts and lowers the rotating drive shaft in conjunction with the connecting member when the connecting member is separated from the cover feed turret, said auxiliary means for removing and installing the cover guide and the cover feed turret comprising:

a swinging member supported proximate said double-seaming machine below the cover feed turret, said swinging member being horizontally swingable to a position underneath the screw member;

a first pedestal replaceably positioned on the swinging member, on which the cover feed turret can be placed when the swinging member is swung to said position underneath the screw member; and a second pedestal replaceably placed on the connecting member, on which the cover guide can be placed when the auxiliary means for removing and installing the rotating drive shaft holds the connecting member at an installing position, said swinging member and said first pedestal being each provided with respective operation holes aligned with each other and through which the screw member can be operated by an operating tool passing through the swinging member and first pedestal from below the swinging member and first pedestal when the swinging member and first pedestal are swung to said position underneath the screw member.

9. An auxiliary equipment as claimed in claim 8, wherein the first pedestal has such a shape that the cover feed turret can be placed on the upper surface thereof, and the operation hole defined in the first pedestal communicates with the operation hole provided in the swinging member.

10. An auxiliary equipment as claimed in claim 9, the upper surface of the first pedestal is close to the lower surface of the cover feed turret when the first pedestal is positioned together with the swinging member right under the screw member, and the operation hole defined in the first pedestal has a concave part capable of receiving a head of the screw member at a position lowed from the cover feed turret when the screw member is unscrewed.

11. An auxiliary equipment as claimed in claim 8, wherein the auxiliary means for removing and installing the rotating drive shaft can hold the connecting member at a position connectable with the cover feed turret.

* * * * *